US009879482B2

(12) United States Patent
Macha

(10) Patent No.: US 9,879,482 B2
(45) Date of Patent: Jan. 30, 2018

(54) EXPANDABLE DIAMETER DRILL BIT

(71) Applicant: Lawrence L. Macha, Gas, KS (US)

(72) Inventor: Lawrence L. Macha, Gas, KS (US)

( * ) Notice: Subject to any disclaimer, the term of this patent is extended or adjusted under 35 U.S.C. 154(b) by 252 days.

(21) Appl. No.: 14/636,907

(22) Filed: Mar. 3, 2015

(65) Prior Publication Data

US 2016/0258221 A1 Sep. 8, 2016

(51) Int. Cl.
*E21B 10/32* (2006.01)
*E21B 10/54* (2006.01)

(52) U.S. Cl.
CPC ..... *E21B 10/325* (2013.01); *E21B 10/54* (2013.01)

(58) Field of Classification Search
CPC ..... E21B 10/325; E21B 10/54; E21B 10/567; E21B 10/60; B23B 51/0009
USPC ..... 175/407, 408, 327
See application file for complete search history.

(56) References Cited

U.S. PATENT DOCUMENTS 1,597,143 A 8/1926 Carter
1,799,559 A * 4/1931 Hunicke ..... E21B 4/04 175/102
2,180,452 A * 11/1939 Boulter ..... E21B 10/003 175/267
2,244,674 A * 6/1941 Cady ..... E21B 10/32 175/289
2,330,083 A 9/1943 Swell
2,488,003 A * 11/1949 Creighton ..... E21B 10/04 175/270
2,754,089 A 7/1956 Kammerer
2,872,160 A 2/1959 Barg
2,982,366 A 5/1961 Camp
3,603,413 A 9/1971 Grill
3,692,126 A 9/1972 Rushing et al.
4,384,627 A 5/1983 Ramirez-Jauregui
4,588,175 A * 5/1986 Martin ..... F16F 1/16 267/155
4,998,981 A 3/1991 Miyanaga
6,691,803 B2 2/2004 Nackerud
6,695,074 B2 2/2004 Nackerud
6,929,076 B2 8/2005 Fanuel et al.
7,179,024 B2 2/2007 Greenhalph
7,854,275 B2 12/2010 Mock et al.
8,122,978 B1 2/2012 Clifford
8,225,884 B2 7/2012 Nackerud
8,668,031 B2 3/2014 Runia
(Continued)

*Primary Examiner* — Nicole Coy
*Assistant Examiner* — Dany E Akakpo
(74) *Attorney, Agent, or Firm* — Dale J. Ream

(57) ABSTRACT

An expandable diameter drill bit includes a cutting blade having receiving and contacting ends, the receiving end having a pivot shaft and the contacting end having a tip. A drill bit includes a drill head body having an upper attachment portion and a lower body portion, the lower body portion defining a blade opening for receiving the receiving end of the cutting blade and a bolt receiving hole on opposing sides transverse the blade opening. The drill bit includes a torsion spring, a first blade leg, and a second body leg. The blade bolt passes through the bolt receiving holes and the pivot shaft and secured with a set screw. The first blade leg is coupled to the cutting blade with a spring retainer bolt, the second body leg is coupled to the drill head body, and the torsion spring biases the blade outwardly from the drill head body.

3 Claims, 5 Drawing Sheets

(56) References Cited

U.S. PATENT DOCUMENTS

| | | | | |
|---|---|---|---|---|
| 2003/0192719 | A1* | 10/2003 | Nackerud | E21B 10/345 175/267 |
| 2004/0262045 | A1 | 2/2004 | Bise | |
| 2007/0205023 | A1* | 9/2007 | Hoffmaster | E21B 10/43 175/408 |

* cited by examiner

EXPANDABLE DIAMETER DRILL BIT

BACKGROUND

This invention relates generally to drilling devices and, more particularly, to an expandable diameter drill bit having a torsion spring for biasing one or more blades outwardly such that a hole being drilled is enlarged.

Rotary drilling devices are used to bore a generally cylindrical hole into the ground to a depth at which a fluid may be extracted, such as water, oil, natural gas, or the like. Sometimes an existing well needs to be re-drilled, cleaned out, or the diameter expanded. A rotary drill may include one or more blades that scrape or dig into the ground surface as the drill rotates. The blades often wear out, break, or otherwise fail and must be replaced, especially when operated at high speed. Another problem with drilling devices is that a drill bit having one diameter may be used and then replaced with a drill bit having a larger diameter in order to increase the diameter of the well.

Although existing rotary drilling devices are presumably effective to drill subsurface wells, they are less effective in operating to increase the diameter of the hole. For instance, some expanding diameter drill bits urge their blades outwardly by centrifugal force and, as a result, require high speed rotation which may not be possible in some subsurface conditions or if debris is building up too quickly within a hole.

Therefore, it would be desirable to have an expandable diameter drill bit having one or more blades that are automatically biased outwardly by respective torsion springs. Further, it would be desirable to have an expandable diameter drill bit having a construction that is less susceptible to blade breakage and more effective in cutting through rock.

SUMMARY

An expandable diameter drill bit according to the present invention includes a cutting blade having a receiving end and a contacting end, the receiving end having a pivot shaft and the contacting end having a tip. A drill bit includes a drill head body having an upper attachment portion and a lower body portion, the lower body portion defining a blade opening for receiving the receiving end of the cutting blade and a bolt receiving hole on each of two opposing sides transverse the blade opening. The drill bit includes a torsion spring having a helical coil, a first blade leg, and a second body leg. The blade bolt passes through the bolt receiving holes and the pivot shaft and is secured into position with a blade bolt set screw. The first blade leg is coupled to the cutting blade with a spring retainer bolt, the second body leg is coupled to the drill head body, and the torsion spring biases the blade outwardly from the drill head body.

The drill bit 10 may be inserted into a hole with the purpose of expanding the hole diameter as it is lowered therein. The drill bit is spun around such that the blades cut away at the edges of the hole. As the diameter of the hole becomes larger, the oppositely biased torsion springs force the blades outward, thus causing the hole to become even larger.

Therefore, a general object of this invention is to provide an expandable diameter drill bit for efficiently drilling a well beneath the surface of the Earth.

Another object of this invention is to provide an expandable diameter drill bit, as aforesaid, in which a pair of blades is pivotally movable between a retracted configuration not extending outwardly from a drill body and an extended configuration extending outwardly from the drill body.

Still another object of this invention is to provide an expandable diameter drill bit, as aforesaid, in which each cutting blade is naturally biased toward the extended configuration by a respective torsion spring.

Yet another object of this invention is to provide an expandable diameter drill bit, as aforesaid, in which each cutting blade may be coated with or include materials that cut more effectively through subsurface compositions and debris.

A further object of this invention is to provide an expandable diameter drill bit, as aforesaid, that cuts more effectively through subsurface compositions and debris.

A still further object of this invention is to provide an expandable diameter drill bit, as aforesaid, in which each cutting blade includes serrated teeth.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An expandable diameter drill bit and method of use will now be described with reference to FIGS. 1 to 4*b* of the accompanying drawings. The drill bit 10 may generally include a drill head body 100 and a plurality of blades 200 secured to the drill head body 100 with a bolt and set screw combination and held in tension with the drill head body 100 via tension springs 300.

Figure 3A:
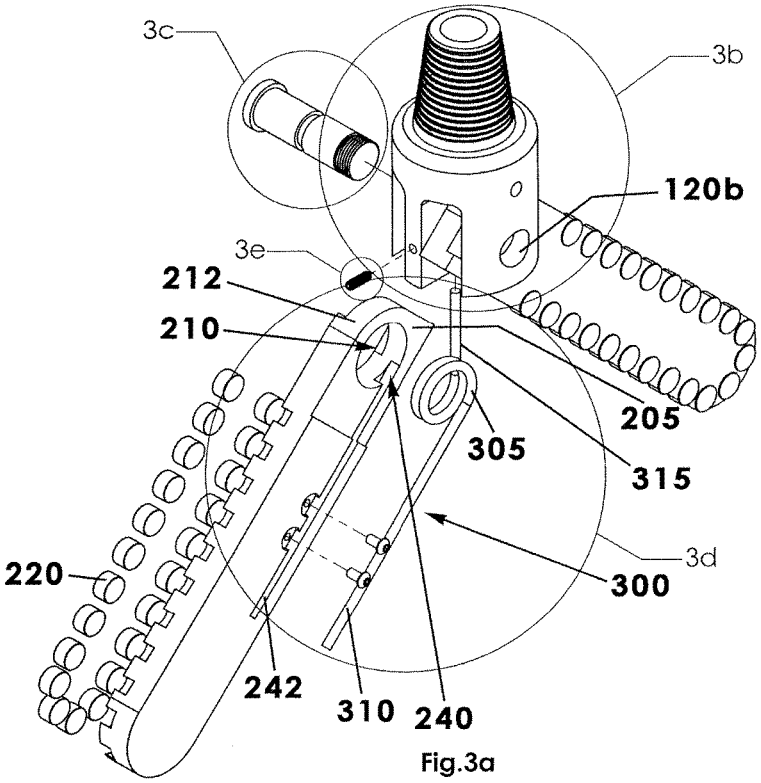
FIG. 3*a* is an exploded view of the expandable diameter drill bit as in FIG. 1.
Figure 3B:
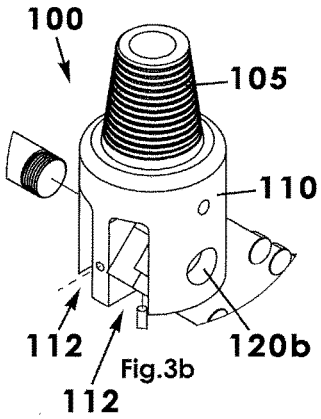
FIG. 3*b* is an isolated view on an enlarged scale taken from FIG. 3*a;*

With reference to FIGS. 3*a* and 3*b*, the drill head body 100 serves as the structural support for the expandable blades 200. The drill head body 100 may have an upper threaded portion 105 for attaching the drill bit to various devices useful for guiding the drill bit underground and a lower body portion 110 for attaching the blades 200 to the drill bit 10. Although not required, the upper threaded portion 105 may be generally conically shaped as shown in the figures.

An outside edge 107 of the upper threaded portion 105 may be inserted into, for example, a drill string (not shown). The threaded portion 105 may be configured such that when the drill bit 10 is connected to the drill string and in use the drill bit 10 does not become loosened. Other means for ensuring semi-permanent connection to the drill string (or other guiding device) is contemplated within the scope of the present invention. It shall also be understood that drill bits generally have a shortened lifespan due to the conditions under which they are used, and therefore, as will be appreciated by those skilled in the art, it may be preferable that the drill bit 10 is removable from the drill string (or other guiding device) at the end of its life.

The upper threaded portion 105 terminates at an inside edge 109 of a top face of the lower body portion 110. The lower body portion 110 may define blade openings 112 for accepting receiving ends 205 of the blades 200. The blade openings 205 may be separated by a divider 115 for ensuring proper positioning of the blades 200 and to prevent the blades 200 from rubbing against each other during use.

Figure 3C:
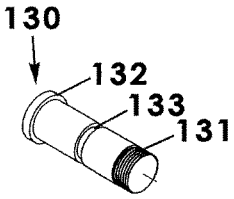
FIG. 3*c* is an isolated view on an enlarged scale taken from FIG. 3*a;*
Figure 3E:
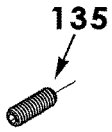
FIG. 3*e* is an isolated view on an enlarged scale taken from FIG. 3*a;*

Bolt receiving holes 120 in opposing sides of the drill head lower body portion 110 and though the center of the divider 115 may generally correspond to holes 210 (pivot shafts) in receiving ends 205 of the blades 200. Referring now to FIG. 3*c*, a threaded end 131 of a blade bolt 130 may be inserted through a first bolt receiving hole 120*a* (FIG. 4*a*) in the drill head lower body portion 110, through the hole 210 (pivot shaft) in the receiving end 205 of a first blade 200, through the hole in the divider 115, through the hole 210 (pivot shaft) in the receiving end 205 of a second blade 200, and through a second bolt receiving hole 120*b* in the drill head lower body portion 110. A head 132 on the end opposite the threaded end 131 of the blade bolt 130 may subsequently come to rest along an outer perimeter 119 of the first receiving hole 120*a* to keep the blade bolt 130 in its preferred position.

A channel 133 (FIG. 3*c*) may be cut around a perimeter of the blade bolt 130 at a length L of the bolt 130 such that when the bolt 130 is inserted through the drill bit lower body portion 110 as described above, the channel 133 is at a position corresponding generally to the hole in the divider 115. A blade bolt set screw hole 125 (FIG. 3*e*) in one or both outside ends of the divider 115 may receive a blade bolt set screw 135, which may fit within the channel 133 in the blade bolt 130. In some embodiments, it may be preferable for the blade bolt set screw 135 to fit within the channel 133 to prevent the blade bolt 130 from shifting laterally but still allow the blade bolt 130 to rotate within the bolt receiving holes 120*a*, 120*b*. In other embodiments, it may be desirable for the blade bolt set screw 135 to be tightened such that the blade bolt 130 is prevented from both shifting laterally and rotating.

The lower body portion 110 may further be equipped with a fluid discharge hole 128. Fluids are often used to reduce friction, provide buoyancy to the drill string, and remove cuttings from the well bore. As the well bore in which the drill is operating is flooded with fluids, the fluid discharge hole 128 may allow for fluids to be discharged away from the drill head body 100.

The blades 200 provide the means by which surface material is displaced to form a hole, and in some particular embodiments, a well bore hole. Each blade 200 may be generally rectangular at the receiving end 205 and culminate at a tip at the surface contacting end 215. The tip may have a rounded configuration as shown in the drawings although a pointed tip may also be used in other embodiments not shown). An upper corner 212 of the blade at the receiving end 205 may be rounded to facilitate rotation of the blade 200 about the blade bolt 130 while situated inside of the blade openings 112.

Outer edges 214 of the blades may be serrated to increase the performance of the blades. Serrated edges may be superior to plain edges because serrated edges tend to grab and cut the material as the blades come into contact with the surface. The blades may be made of any material strong enough to withstand the high forces exerted on the blades as they rotate and cut away at the surface. Exemplary materials include steel, steel alloys, tungsten carbide, cubic boron nitride, et cetera.

In addition to the blades themselves, the edges may be coated in a material exhibiting superior hardness properties thereby increasing the effectiveness of the blades and the life of the drill. In some embodiments, the edges 214 may additionally or alternately be equipped to receive an insert 220, such as that shown in FIG. 3*a*. The insert 220 may also be constructed of a material exhibiting superior hardness properties. Exemplary materials include tungsten carbide, cubic boron nitride, diamond, et cetera.

It should be noted that the blades may be any desired length based on the requirements of a particular project (e.g., 20", 25", 30", 35", 40", 45", etc.). Additionally, while the embodiments described herein focus on the use of two opposing blades, additional or fewer blades could be used depending on the particular project.

Figure 2A:
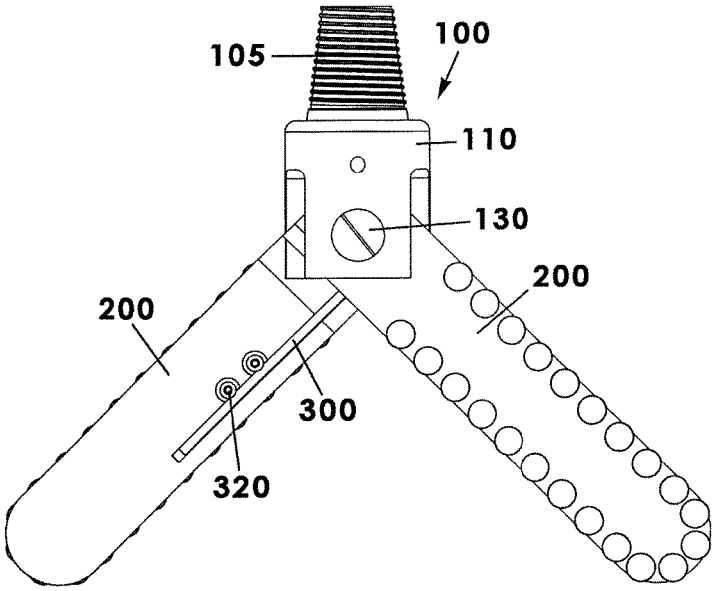
FIG. 2*a* is a front view of the expandable diameter drill bit as in FIG. 1.
Figure 2B:
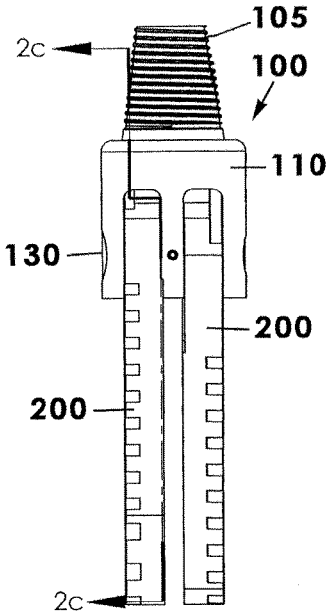
FIG. 2*b* is a side view of the expandable diameter drill bit as in FIG. 2*a;*
Figure 2C:
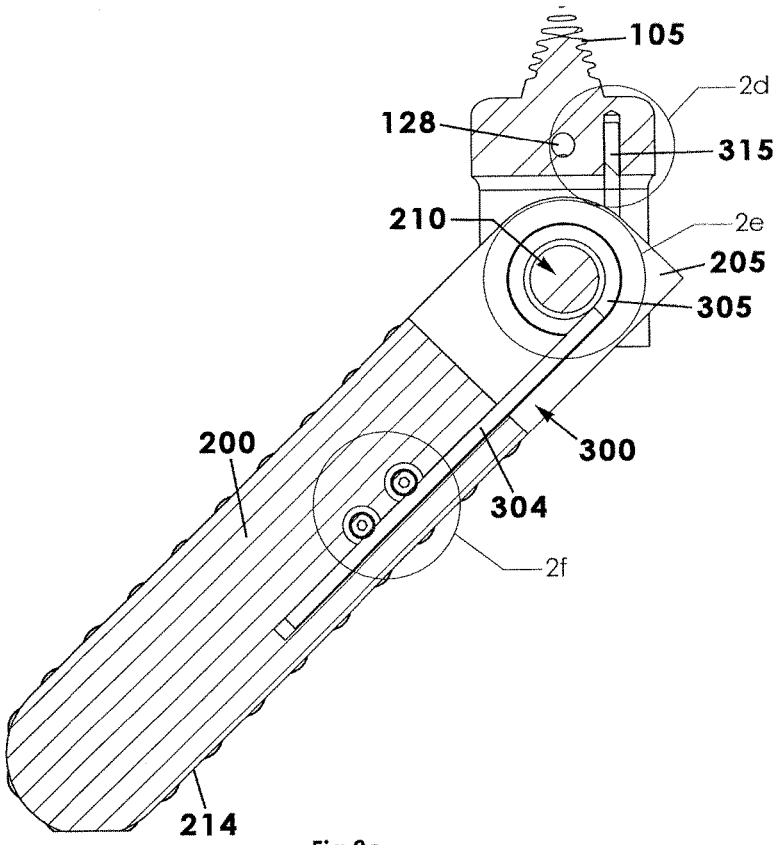
FIG. 2*c* is a section view taken along line 2*c*-2*c* of FIG. 2*b;*
Figure 2D:
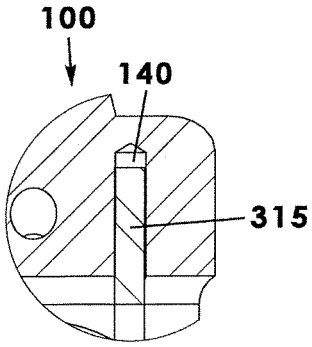
FIG. 2*d* is an isolated view on an enlarged scale taken from FIG. 2*c;*
Figure 2E:
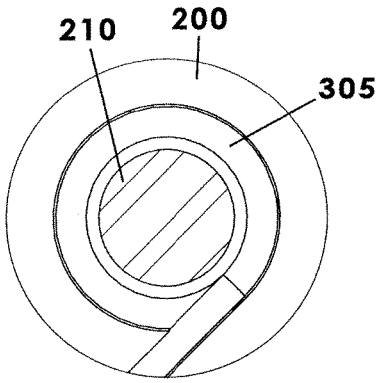
FIG. 2*e* is an isolated view on an enlarged scale taken from FIG. 2*c;*
Figure 2F:
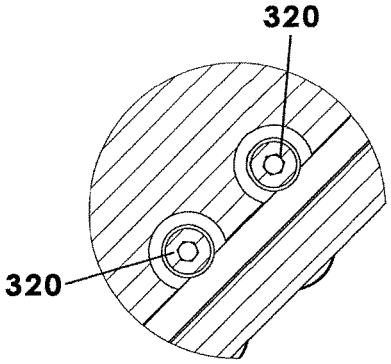
FIG. 2*f* is an isolated view on an enlarged scale taken from FIG. 2*c;*
Figure 3D:
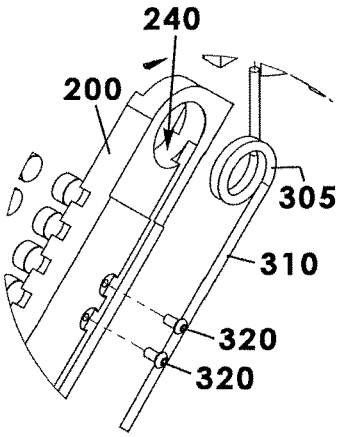
FIG. 3*d* is an isolated view on an enlarged scale taken from FIG. 3*a;*
Figure 4A:
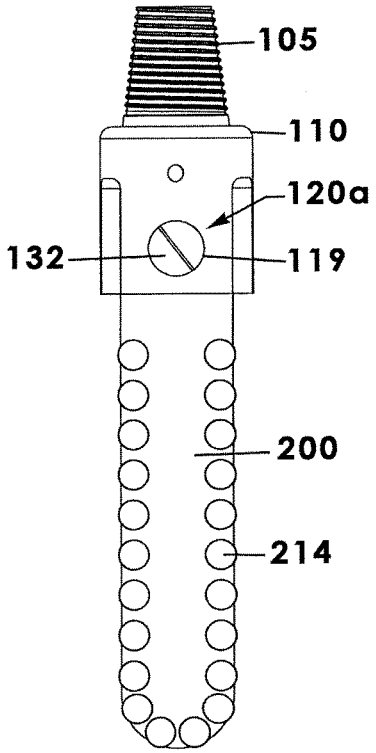
FIG. 4*a* is a front view of the expandable diameter drill bit according to the present invention illustrated in a retracted configuration.
Figure 4B:
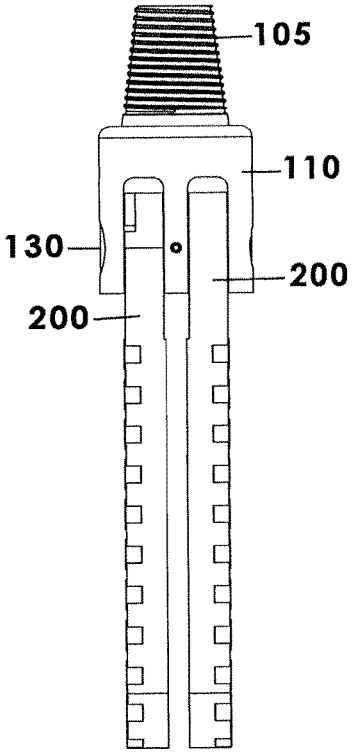
FIG. 4*b* is a side view of the expandable diameter drill bit as in FIG. 4*a*.

With reference to FIG. 2*c*, tension springs 300 may act to keep the blades 200 in tension with respect to the drill head body 100. The springs 300 may be, for example, helical torsion springs having a central coil 305 with a first blade leg 310 extending along a length of the blade 200 and a second body leg 315 extending toward and attaching to the base 100. The central coil 305 may fit into a recess 240 in the pivot shaft 210 and the first blade leg 310 may fit into a recess 242 in the blade 200 (FIGS. 2*e* and 3*d*). The first blade leg 310 may be secured into place via one or more spring retainer bolts 320 (FIG. 2*f*). The second body leg may be inserted into a cavity 140 in the drill head body 100 (FIG. 2*d*).

Figure 1:
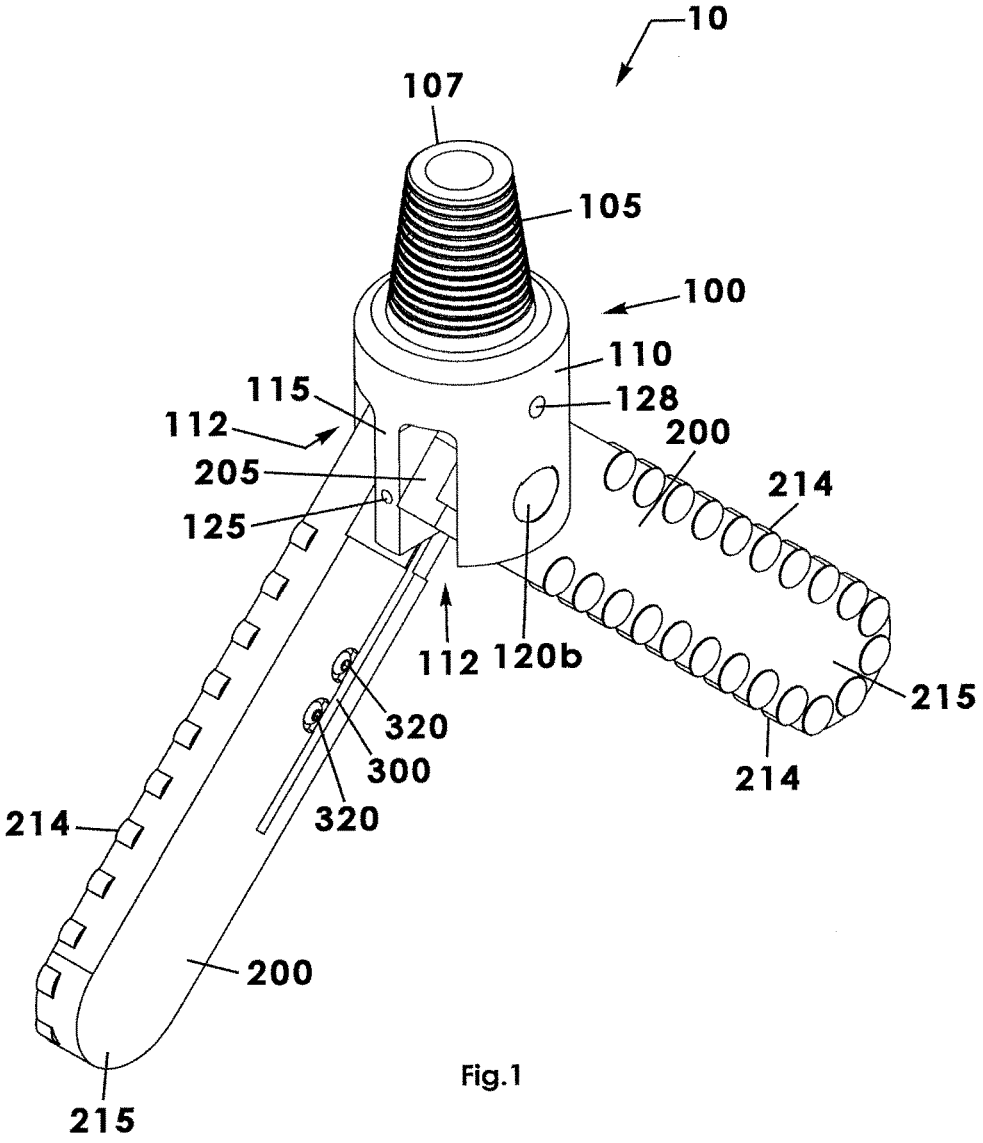
FIG. 1 is a perspective view of an expandable diameter drill bit according to a present embodiment of the present invention illustrated in an expanded configuration.

When the springs 300 are in full tension, the blades 200 are in a retracted position as illustrated in FIGS. 1 and 2*a*. When retracted, such as to about a 4" diameter, the drill bit 10 may be inserted into a ground hole that is intended to be drilled or enlarged. In a retracted position, the blades 200 may not exhibit any substantial hole-widening capabilities. However, the mechanical energy stored in the springs 300 as a result of the central coil 305 constantly acts to push the blades outward or away from the retracted position. FIG. 2*a* illustrates the springs 300 pushing the blades 200 outward toward an expanded configuration (FIG. 1). The mechanical energy can thus be altered by modifying the central coil 305 (e.g., increasing the tension or decreasing the tension in the spring). Therefore, as the blades 200 cut away at the interior surface of a hole, the blades may be pushed further outward as a result of the tension springs 300, thereby increasing the diameter of the hole in the surface. It may be preferable for the blades 200 to extend in opposite directions from each other to obtain the highest possible degree of surface displacement. In an embodiment, a diameter of the blades in the extended configuration may be about 24" although other diameters would be effective depending on individual blade lengths.

In use, the drill bit 10 is inserted into a hole with the purpose of expanding the hole diameter. The blades 200 may first be in the retracted configuration so as to fit into the hole as described above. The drill bit 10 is spun around such that the blades 200 cut away at the edges of the hole. As the hole becomes larger (i.e. has a larger diameter), the springs 300 force the blades 200 outwardly, thus causing the hole to become even larger.

While many methods of manufacturing the drill head body 100 and blades 200 are contemplated within the scope of the present invention, some exemplary methods include die casting, molding, forging, extruding, machining, et cetera.

Many different arrangements are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. Further, it will be understood that certain features and subcombinations are of utility and may be employed without reference to other features and subcombinations and are contemplated within the scope of the claims. The description should not be restricted to the specific described embodiments.

What is claimed is:

1. An expandable diameter drill bit, comprising:

a first cutting blade and a second cutting blade, each cutting blade having a receiving end and a contacting end;

wherein the first and second cutting blades are coated with a diamond material;

a drill head body having an upper attachment portion and a lower body portion, the lower body portion defining a first blade opening and a second blade opening configured to receive respective receiving ends of respective cutting blades, the first blade opening and the second blade opening being separated by a divider;

a first torsion spring coupled to the first cutting blade and to the drill head body;

a second torsion spring coupled to the second cutting blade and to the drill head body;

a blade bolt inserted transversely through the lower body portion and the first and second cutting blades, the first cutting blade and the second cutting blade being configured to pivot about the blade bolt;

wherein the first and second torsion springs bias the blades outwardly from the drill head body in opposing directions respectively;

wherein:

the first blade leg of the first torsion spring is secured in a recess having a longitudinally extending configuration defined by the first cutting blade with a spring retainer bolt;

the second body leg of the first torsion spring is inserted into the drill head body;

the first blade leg of the second torsion spring is secured in a recess having a longitudinally extending configuration defined by the second cutting blade with a spring retainer bolt;

the second body leg of the second torsion spring is inserted into the drill head body;

said first blade legs of said first and second torsion springs, respectively, are elongate and longer than said second body legs of said first and second torsion springs, respectively.

2. The drill bit of claim 1, wherein the cutting blades have serrated edges.

3. The drill bit of claim 1, wherein the lower body portion defines a fluid discharge hole for discharging fluid away from the drill bit.

* * * * *